US009974380B2

(12) United States Patent
Beuer

(10) Patent No.: US 9,974,380 B2
(45) Date of Patent: May 22, 2018

(54) APPLICATION TOOL

(71) Applicant: Henkel AG & Co. KGaA, Duesseldorf (DE)

(72) Inventor: Bernd Beuer, Monheim (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days. days.

(21) Appl. No.: 14/736,539

(22) Filed: Jun. 11, 2015

(65) Prior Publication Data

US 2015/0273517 A1 Oct. 1, 2015

Related U.S. Application Data

(63) Continuation of application No. PCT/EP2012/075508, filed on Dec. 14, 2012.

(51) Int. Cl.

| | |
|---|---|
| ***A46B 1/00*** | (2006.01) |
| ***B05C 17/10*** | (2006.01) |
| ***A46B 9/02*** | (2006.01) |
| ***A46D 1/00*** | (2006.01) |
| ***A46B 3/00*** | (2006.01) |
| ***B43M 11/06*** | (2006.01) |

(52) U.S. Cl.

CPC ..... *A46B 1/00* (2013.01); *A46B 3/005* (2013.01); *A46B 9/02* (2013.01); *A46D 1/0238* (2013.01); *B05C 17/10* (2013.01); *B43M 11/06* (2013.01); *A46B 2200/20* (2013.01)

(58) Field of Classification Search

CPC .. A46B 1/00; A46B 3/005; A46B 3/22; A46B 9/00; A46B 9/02; A46B 9/021; A46B 2200/20; A46B 9/202; A46B 9/205; A46B 9/207; A46D 1/0238; B05C 17/00; B05C 17/10; A45D 27/04; A45D 34/042

USPC ..... 15/187, 188, 207.2

See application file for complete search history.

(56) References Cited

U.S. PATENT DOCUMENTS

| | | | | |
|---|---|---|---|---|
| 3,302,230 | A * | 2/1967 | Poppelmann | A46B 1/00 15/104.94 |
| 4,469,223 | A | 9/1984 | Smith | |
| 5,926,900 | A | 7/1999 | Bennett | |
| 2003/0163884 | A1 | 9/2003 | Weihrauch | |
| 2006/0179594 | A1 | 8/2006 | Yeung | |
| 2007/0006411 | A1* | 1/2007 | Foster | A46B 5/02 15/207.2 |

FOREIGN PATENT DOCUMENTS

| | | |
|---|---|---|
| CH | 531406 | 12/1972 |
| DE | 293718 | 9/1991 |

(Continued)

OTHER PUBLICATIONS

International Search Report in connection with International Patent Application No. PCT/EP2012/075508 dated Apr. 10, 2013.

*Primary Examiner* — Mark Spisich
(74) *Attorney, Agent, or Firm* — James E. Piotrowski

(57) ABSTRACT

The invention relates to an application tool (1) for adhesives and/or sealants, having a holding area (10) with a handle (11) and having an application area (20) comprising a shank (21) from which a plurality of bristles (22) protrude in the direction of an application side (26). A row of adjacently situated bristles (22) is provided on the shank (21), and the shank (21) and the bristles (22) are formed in one piece and are made of a plastic material.

11 Claims, 3 Drawing Sheets

(56) References Cited

FOREIGN PATENT DOCUMENTS

Figure 1:
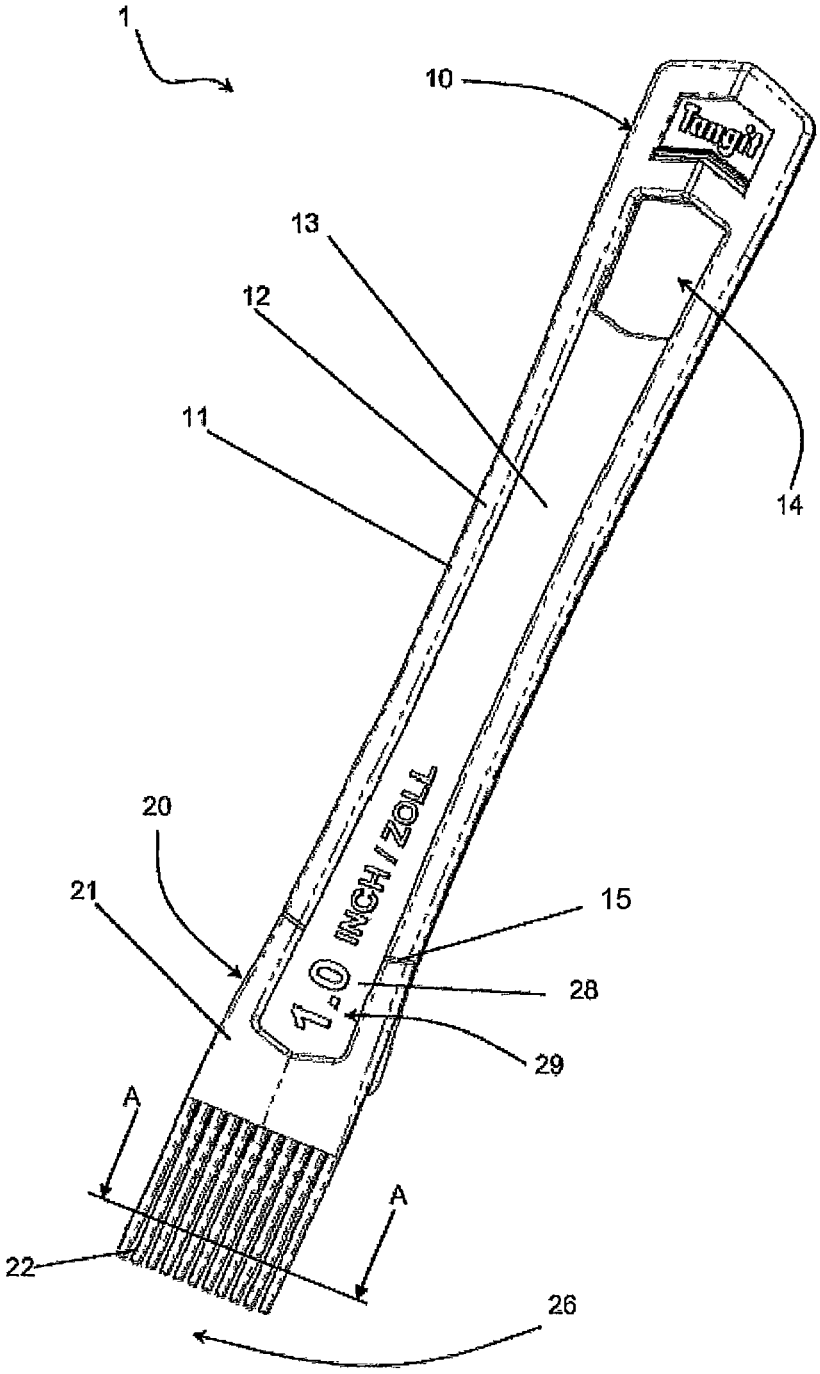

| | | | |
|---|---|---|---|
| DE | 202010009236 | | 11/2011 |
| EP | 1591036 | * | 11/2005 |
| FR | 2922421 | | 4/2009 |
| FR | 2926012 | | 7/2009 |
| JP | 2004351731 | | 12/2004 |
| JP | 2007-135964 | * | 6/2007 |
| WO | 9409677 | | 5/1994 |
| WO | 2010118765 | | 10/2010 |
| WO | 2010122681 | | 10/2010 |

* cited by examiner

Detail B

Detail C

APPLICATION TOOL

The present invention relates to an application tool for adhesives and/or sealants. These types of tools are used, for example, for applying adhesives to the connecting areas of PVC pipes. However, other fields of application, in particular in the hobby, home, and skilled craft sectors, as well as in industry, for example for joining profiles and sheets of all types, are conceivable. For applying adhesives and/or sealants, spatulas or spreaders are generally used. However, these may be difficult to handle, for example because the application area is too rigid. The use of standard bristle brushes is also conceivable, but they are difficult to clean, and therefore appear to be unsuitable for repeated use.

The object of the present invention, therefore, is to provide an improved application tool for adhesives and/or sealants.

This object is achieved by the features of claim 1.

Advantageous refinements of the invention are set forth in the subclaims.

The basic concept is the use of an application tool for applying adhesives and/or sealants, in particular reactive adhesives and/or sealants, having a holding area with a handle, and having an application area comprising a shank from which a plurality of application bristles protrude in the direction of an application side, wherein only one row of application bristles which are adjacently situated and preferably parallel to one another in the direction of an application side is provided on the shank, and the application area, the shank, and the application bristles are formed in one piece and are made of a plastic material or are encased with a plastic material, and at least one bristle on its side facing an oppositely situated second bristle has at least one beveled or rounded edge. Application bristles are understood to mean synthetic bristles made of a plastic material, and in particular are not made of animal hairs.

In one variant, the shank and application bristles may be formed in one piece, but are not made completely of a plastic material. It is conceivable, for example, to use a first material, for example wood, cardboard, or metal, for the core of the shank and/or the application bristles, the core being coated or encased with a plastic material, in particular a polyethylene or a polypropylene. In addition, use of a first plastic material for the core, and a second plastic material, in particular a polyethylene or a polypropylene, for a coating or an encasement is conceivable.

A flat application of the adhesive and/or sealant to a substrate may be achieved by using an application area which provides a row of adjacently situated application bristles. In addition, the individual bristles ensure comprehensive options for use, since individual bristles or groups of bristles, for example, may be deflected or displaced when there are obstructions such as raised areas in the substrate. Application of the adhesive and/or sealant is thus facilitated. Furthermore, the cleaning of residues of an adhering adhesive and/or sealant, in particular of the reactive type, from the application tool after use may be simplified by such a design.

Providing the shank and bristles in one piece results in simplification of the manufacture of an application tool according to the invention, and thus, cost savings.

Another advantage is the use of a plastic material for the bristles and the shank to allow simple cleaning. A polypropylene or a polyethylene in particular has proven to be practical. An application tool of this design allows simple cleaning, and may therefore be used multiple times. In addition, the application tool may be used for a wide range of adhesives and/or sealants.

A further advantage is the design of the application tool in such a way that the holding area and the application area are formed in one piece. In particular, it is conceivable to manufacture the entire application tool in one production step, in particular by an injection molding process, which may minimize the level of manufacturing effort.

In addition, it has proven to be advantageous that at least one bristle has a substantially rectangular cross section. However, preferably all bristles have a rectangular cross section. The side length of the cross section of a bristle in the direction of extension of the row of adjacently situated bristles is preferably greater than the side length orthogonally with respect to the first-mentioned side length. The side length in the direction of extension is preferably in the range of 1.5 mm to 2.5 mm, and the second side length, which is provided orthogonally with respect to the first side length, in turn is preferably in the range of 0.5 mm to 1 mm.

A further advantage is a spacing of two oppositely situated bristles in each case, preferably a spacing in the range of 0.1 mm to 1 mm, in particular for increasing the flexibility of the application tool in the application area.

In one advantageous refinement, at least one bristle has at least one beveled or rounded edge on its side facing an oppositely situated second bristle. The size of the bevel may be in the range of 0.1 mm to 0.3 mm for a regular angle of 45°. However, other suitable angles are also conceivable. One conceivable rounding preferably has a radius in the range of 0.1 mm to 0.4 mm. All the edges of all bristles, which are provided at the sides of the bristles and which are opposite from a respective further bristle, are preferably beveled or rounded. In addition, all the edges of all bristles may have a bevel or rounding. For the above-mentioned use of bristles having a rectangular cross section, this shape of the edge results in a cross section in the shape of a partially or completely rounded or beveled rectangle.

With such a shape of the bristles, in particular a comb structure of the adhesive and/or sealant on the substrate due to the design of the application tool, which could have an effect on the adhesive bond or seal, may be minimized. In one variant, the bristles may also be connected to one another by thin material areas, so that on the one hand sufficient flexibility may be ensured, and on the other hand the comb structure may be avoided or reduced. In another variant, the bristles may be adjacently situated in such a way that their distances from one another are minimized, and in particular are less than 0.1 mm, which, however, requires a higher level of manufacturing effort.

A further advantage is the use of bristles which become thinner and/or narrower in the direction of the application side and/or which taper in the direction of the application side. This has the advantage that the bristles on the application side are flexible, and for this purpose have greater stability on the opposite side. The preferred distance between two oppositely or adjacently situated bristles is preferably to be determined on the application side.

A further advantage is the use of a thermoplastic plastic, in particular a polypropylene or a polyethylene, as the plastic material for the holding area and/or the application area. In particular HDPE, LDPE, or LLDPE or a mixture of same is conceivable as polyethylene.

In one advantageous refinement, the application tool has a protruding support means preferably situated on or in the vicinity of the application area to allow an option for resting the application tool on a substrate without the bristles coming into contact with the substrate.

A further advantage is the design of the handle area in such a way that it has, at least in areas, a cross section of a profiled support, in particular a double T shape. A high level of stability of the handle area may thus be achieved at low material cost.

A preferred embodiment of an application tool according to the invention is illustrated in the figures.

Figure 2:
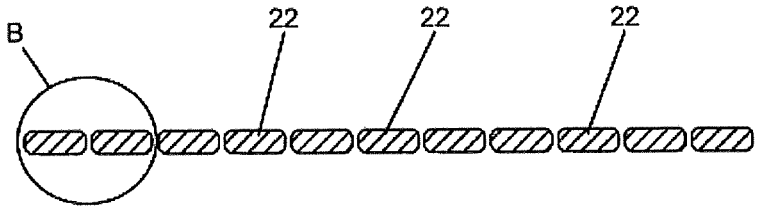
Figure 3:
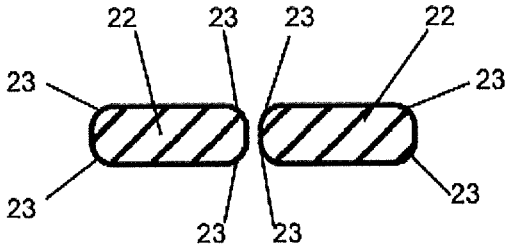
Figure 4:
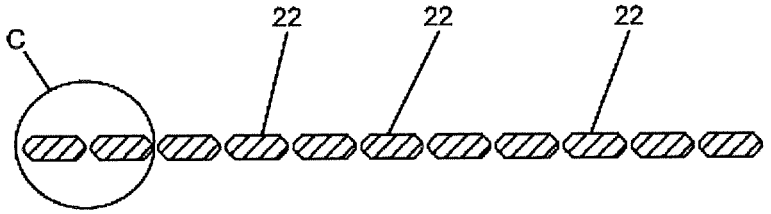
Figure 5:
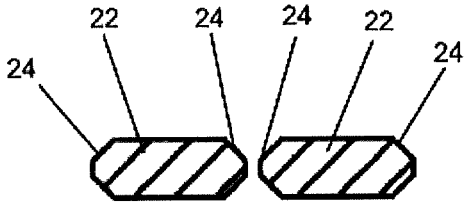
Figure 6:
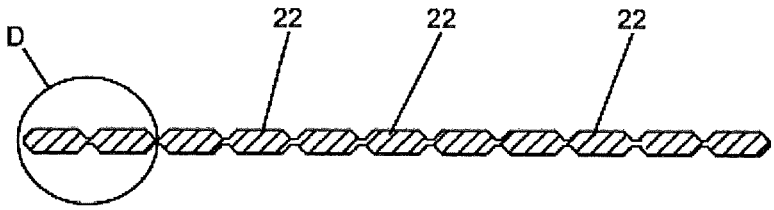
Figure 7:
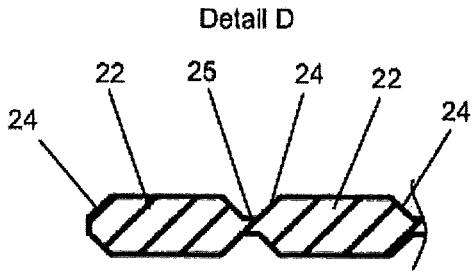
Figure 8:
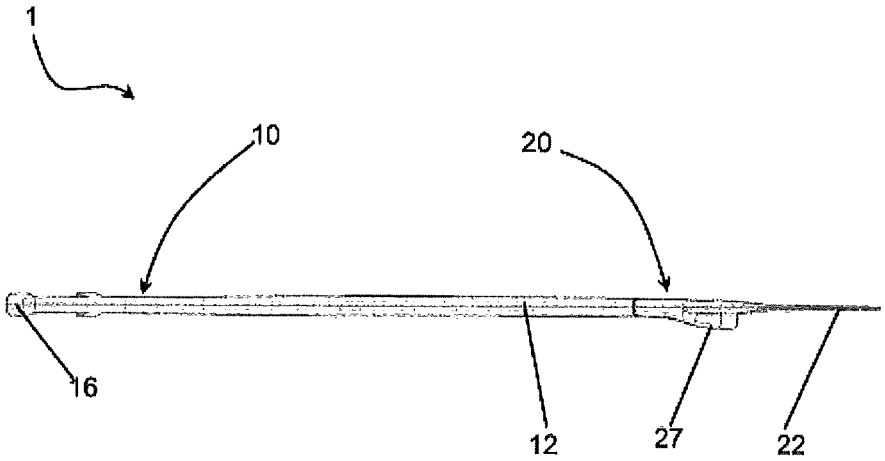

The figures show the following:

FIG. 1 shows a perspective view of an application tool according to the invention, FIG. 2 shows a sectional view of the bristles along the section line A-A, FIG. 3 shows a detail B of FIG. 2, FIG. 4 shows an alternative sectional view of the bristles along the section line A-A, FIG. 5 shows a detail C of FIG. 4, FIG. 6 shows an alternative sectional view of the bristles along the section line A-A, FIG. 7 shows a detail D of FIG. 6, and FIG. 8 shows a side view of the application tool from FIG. 1.

FIG. 1 shows a perspective view of an application tool 1 according to the invention for applying adhesives and/or sealants, having a proximal holding area 10 with a gripping area, handle area, or handle 11 for short, for guiding the tool, and having a distal application area 20 comprising a shank 21, from which a plurality of application bristles 22 protrude in the direction of an application side 26.

The holding area 10 has a pin- or rod-shaped design in the area of the handle 11, and may be equipped with slip-resistant areas to allow a secure hold on the application tool 1. In addition, the basic shape of the holding area 10 in the area of the handle 11 has a cross section in the shape of a double T, so that the outer edge is provided by a circumferential reinforcing edge 12 around the holding area 10. The reinforcing edge 12 surrounds a flat central web 13, which has a smaller material thickness than that of the reinforcing edge 12. In the proximal area of the holding area 10, a recess which may be used as a hanging eyelet 14 is provided in the central web 13 for hanging the application tool 1, in particular in a salesroom. The holding area 10 is made of a plastic material; in the embodiment shown, the holding area is made of a polyethylene and has been manufactured by means of an injection molding process.

In the same injection molding process, the application area 20 having the shank 21 and application bristles 22, made of the same plastic material, has been integrally molded onto the holding area 10. The application tool 1 is thus formed in one piece, and therefore requires no final assembly of individual parts. A separating section 15 is provided in the transition between the holding area 10 and the application area 20. At this point the injection mold may be modified in such a way that an alternative mold area may be used for the application area 20, so that application areas 20 which are variable, in particular with regard to the configuration of the application bristles 22 or the width of the application area 20 on the application side 26, are possible, wherein the same mold area may be used for the holding area 10. However, in one variant it is possible to produce the holding area 10 and application area 20 separately and to join them at the separating section 15.

The application bristles 22 are adjacently situated in one row on the shank 21 in such a way that the adjacently situated application bristles 22 lie in a plane. The surface of the central web 13 is substantially parallel to this plane to facilitate guiding of the application tool for the user. The shank 21 and the application bristles 22 are formed in one piece, and are made of the stated plastic material; in the exemplary embodiment shown they are made of a polyethylene.

The application bristles 22 are spaced apart from one another in particular for increasing their flexibility. Thus, two adjacently or oppositely situated application bristles in each case have a spacing of 0.2 mm on the application side 26. In addition, the application bristles 22 taper slightly in the direction of the distal application side 26, starting from the shank 21, to ensure sufficient stability in the area of the shank 21, but also to be as flexible as possible in the area of the application side 26. The shank 21 also has a transition area 28, into which the central web 13 of the holding area 10 merges. The transition area 28 contains an embossed size indicator 29 for indicating the size of the application area 20.

FIG. 2 shows a sectional view of the application bristles 22 along the section line A-A in the direction of the application side 26. The application bristles 22 have a substantially rectangular cross section, in each case the longer side length of the rectangular cross section lying in the plane of the adjacently situated application bristles 22.

FIG. 3 shows a detail B of FIG. 2, in which only two of the application bristles 22 are visible in an enlarged view. The application bristles 22 have roundings 23 on all edges. The roundings 23 have a radius of 0.3 mm, and the spacing between the application bristles 22 at the end of the application side 26 is 0.2 mm. In particular, the roundings 23 are provided at edges on the respective side of an application bristle 22 facing an oppositely situated further application bristle 22. The substantially rectangular cross section has correspondingly rounded corners.

FIG. 4 shows an alternative sectional view of the application bristles 22 along the section line A-A in the direction of the application side 26. Here as well, the application bristles 22 have a substantially rectangular cross section. A detail C of FIG. 4 is shown in FIG. 5, wherein the two depicted application bristles 22 are visible in an enlarged view and have bevels 24 on all edges. The bevels 24 have dimensions of 0.25 mm×45°. The spacing between the application bristles 22 at the end of the application side 26 is 0.2 mm. The substantially rectangular cross section has correspondingly rounded corners.

FIG. 6 shows a further alternative sectional view of the application bristles 22 along the section line A-A in the direction of the application side 26. Here as well, the application bristles 22 have a substantially rectangular cross section. A detail D of FIG. 6 is shown in FIG. 7, wherein the two depicted application bristles 22 are visible in an enlarged view and have bevels 24 on all edges. Here as well, the bevels 24 have dimensions of 0.25 mm×45°. The spacing between the application bristles 22 at the end of the application side 26 is 0.2 mm. The substantially rectangular cross section has correspondingly rounded corners. In addition, two adjacent application bristles 22 in each case are connected to one another via a web 25 in each case, one web 25 being centrally situated in each case on the side face of a first application bristle 22 opposite from an adjacent second application bristle 22, and extending along the application bristle 22 from the shank 21 up to the application end 26, thus connecting two adjacent application bristles 22 to one another.

In one alternative, it is also conceivable that not all edges of the application bristles 22 shown in FIGS. 2 to 7 are beveled or rounded; rather, only those edges of an application bristle 22 that are provided on a side of the application bristle 22 which faces a further oppositely or adjacently situated application bristle 22 are beveled or rounded.

FIG. 8 shows a side view of an application tool 1 according to the invention. The proximal end of the holding area 10 forms an end piece 16 having a section which protrudes from the reinforcing edge 12 and which is used for resting on a substrate. A protruding support projection 27 which is likewise used for resting the application tool 1 on a substrate is provided at the oppositely situated application area 20. The support projection 27 protrudes farther than the protruding section of the end piece 16, so that the application tool 1, when supported on a flat substrate, is closer to the substrate at the areas with the proximal holding area 10 than at the areas with the distal application area 20, in order to avoid contact of the application bristles 22, possibly provided with an adhesive and/or sealant, with the substrate. In one variant, the protruding section of the end piece 16 may be dispensed with. A support means may thus be provided in particular by the support projection 27 to allow an option for resting the application tool 1 on a substrate without the application bristles 22 coming into contact with the substrate.

| List of reference numerals | |
|---|---|
| 1 | Application tool |
| 10 | Holding area |
| 11 | Handle |
| 12 | Reinforcing edge |
| 13 | Central web |
| 14 | Hanging eyelet |
| 15 | Separating section |
| 16 | End piece |
| 20 | Application area |
| 21 | Shank |
| 22 | Application bristles |
| 23 | Rounding |
| 24 | Bevel |
| 25 | Web |
| 26 | Application side |
| 27 | Support projection |
| 28 | Transition area |
| 29 | Size indicator |

What is claimed is:

1. An application tool for adhesives and/or sealants, having a holding area with a handle; a single row of a plurality of adjacently situated bristles protruding in the direction of an application side; and a shank having at least one substantially planar face aligned with the row of bristles, the shank defining the area between the holding area and the bristles, wherein the holding area, the shank, and the bristles are formed in one piece and are made of a plastic material or are encased with a plastic material, and the bristles have a substantially rectangular cross section and each bristle has a beveled edge defined by two opposing beveled portions, the beveled edge of one said bristle aligned with the beveled edge of an adjacent bristle in the row.

2. An application tool (1) according to claim 1, wherein two oppositely situated bristles (22) in each case are spaced apart from one another.

3. An application tool (1) according to claim 1, wherein the bristles (22) become thinner and/or narrower in the direction of the application side (26) and/or taper in the direction of the application side.

4. An application tool (1) according to claim 1, wherein a polypropylene or a polyethylene is used as the plastic material for the holding area (10) and/or an application area (20).

5. An application tool (1) according to claim 1, wherein a protruding support means (27) is provided to allow an option for resting the application tool (1) on a substrate without the bristles (22) coming into contact with the substrate.

6. An application tool (1) according to claim 1, wherein the holding area (10) has, at least in areas, a cross section of a profiled support or an essentially double T shape.

7. An application tool (1) according to claim 1, wherein the holding area has, at least in areas, a cross sectional double T shape.

8. An application tool according to claim 1, wherein the holding area has a reinforcing edge with a first thickness on each side of the handle and a central web having a second thickness less than the reinforcing edge first thickness connecting the reinforcing edges.

9. An application tool according to claim 1, wherein the holding area handle has a reinforcing edge with a first thickness on each side of the handle, a central web having a second thickness less than the reinforcing edge first thickness connects the reinforcing edges and the reinforcing edges and web define an aperture through the handle.

10. An application tool according to claim 1, wherein the opposing beveled portions terminate at a planar portion, the planar portion of one edge parallel to the planar portion of an adjacent bristle in the row.

11. An application tool having a holding area with a handle; a single row of a plurality of adjacently situated bristles protruding in the direction of an application side; and a shank having at least one substantially planar face aligned with the row of bristles, the shank defining the area between the holding area and the bristles, wherein the holding area, the shank, and the bristles are formed in one piece and are made of a plastic material or are encased with a plastic material, and the bristles have a substantially rectangular cross section and each bristle has a beveled or rounded edge aligned with the beveled or rounded edge of an adjacent bristle in the row and wherein two oppositely situated bristles are connected to one another by a web.

* * * * *